US010184311B2

(12) United States Patent
Gadre et al.

(10) Patent No.: US 10,184,311 B2
(45) Date of Patent: Jan. 22, 2019

(54) WELLHEAD SEAL ASSEMBLY WITH LOCKDOWN AND SLOTTED ARRANGEMENT

(71) Applicant: Vetco Gray Inc., Houston, TX (US)

(72) Inventors: Aniruddha D. Gadre, Houston, TX (US); Mayur Mansukh, Houston, TX (US); Joseph W. Pallini, Houston, TX (US); David Lawrence Ford, Houston, TX (US); Baozhi Zhu, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 418 days.

(21) Appl. No.: 14/918,791

(22) Filed: Oct. 21, 2015

(65) Prior Publication Data

US 2017/0114605 A1 Apr. 27, 2017

(51) Int. Cl.
*E21B 33/04* (2006.01)
*E21B 33/00* (2006.01)

(52) U.S. Cl.
CPC ..... *E21B 33/04* (2013.01); *E21B 33/0422* (2013.01); *E21B 2033/005* (2013.01)

(58) Field of Classification Search
CPC . E21B 33/04; E21B 33/0422; E21B 2033/005
See application file for complete search history.

(56) References Cited

U.S. PATENT DOCUMENTS 4,759,409 A * 7/1988 Gullion ..... E21B 33/043 166/182
4,790,572 A * 12/1988 Slyker ..... E21B 33/043 166/182
4,928,769 A * 5/1990 Milberger ..... E21B 33/043 166/182
4,949,786 A * 8/1990 Eckert ..... E21B 33/04 166/208
5,031,695 A * 7/1991 Cain ..... E21B 33/0422 166/208

(Continued)

OTHER PUBLICATIONS

U.S. Appl. No. 14/551,263, filed Nov. 24, 2014 entitled: Casing Hanger Shoulder Ring for Lock Ring Support.

(Continued)

*Primary Examiner* — Benjamin F Fiorello
(74) *Attorney, Agent, or Firm* — Hogan Lovells US LLP

(57) ABSTRACT

A wellhead assembly has a casing hanger for supporting a string of casing, the casing hanger having an external upward-facing shoulder. A radially movable annular lock-down member is carried on the shoulder for movement between a retracted position while the casing hanger is being run and an expanded position. In the expanded position, the lockdown member is in engagement with a lockdown profile shoulder in a wellhead housing. A casing hanger seal is carried by the casing hanger above the lockdown member. The casing hanger seal has a lower extension that includes a connection leg and a nose ring. The nose ring has a cam surface that engages and moves the lockdown member to the expanded position while the casing hanger seal is being lowered into a set position. Slots are formed in the extension to reduce the axial stiffness.

18 Claims, 3 Drawing Sheets

(56) References Cited

U.S. PATENT DOCUMENTS

| | | | | |
|---|---|---|---|---|
| 5,060,724 | A * | 10/1991 | Brammer | E21B 33/03 166/208 |
| 5,110,144 | A | 5/1992 | Burton | |
| 7,677,319 | B2 * | 3/2010 | Baskett | E21B 33/035 166/360 |
| 7,762,319 | B2 * | 7/2010 | Nelson | E21B 33/04 166/368 |
| 8,205,670 | B2 | 6/2012 | Nelson | |
| 8,631,878 | B2 | 1/2014 | Duong | |
| 8,695,700 | B2 | 4/2014 | Gette | |
| 8,720,586 | B2 | 5/2014 | Duong | |
| 8,851,194 | B2 | 10/2014 | Ford | |
| 8,925,639 | B2 | 1/2015 | Benson | |
| 8,936,092 | B2 | 1/2015 | Nguyen | |
| 2010/0147533 | A1 * | 6/2010 | Nelson | E21B 33/04 166/379 |
| 2012/0098203 | A1 | 4/2012 | Duong | |
| 2013/0146306 | A1 | 6/2013 | Yates et al. | |
| 2014/0183824 | A1 | 7/2014 | Benson | |
| 2015/0114668 | A1 | 4/2015 | Mansukh et al. | |

OTHER PUBLICATIONS

High-Performance Metal-Seal System for Subsea Wellhead Equipment, Offshore Technology Conference, 1989, L.J. Milberger, et al.
Wellhead System to Pretension the Casing and Metal Seal the Annulus for Hot Deep, Corrosive Wells, Offshore Technology Conference, 1989, D.S. Christie, et al.
PCT Search Report and Written Opinion issued in connection with corresponding PCT Application No. PCT/US16/53037 dated Jan. 17, 2017.

* cited by examiner

WELLHEAD SEAL ASSEMBLY WITH LOCKDOWN AND SLOTTED ARRANGEMENT

BACKGROUND OF THE INVENTION

1. Field of the Invention

This invention relates in general to wellhead assemblies and in particular to an annulus seal assembly having a casing hanger lockdown feature and slots to reduce axial stiffness and direct upward forces on the casing hanger info the wellhead housing.

2. Description of Prior Art

A subsea well that is capable of producing oil or gas typically has an outer or conductor housing secured to a string of conductor pipe which extends some short depth into the well. An inner or high pressure wellhead housing lands in the conductor housing and secures to an outer or first string of casing, which extends coaxially through the conductor to a deeper depth into the well. Depending on the particular conditions of the geological strata above the target zone (typically, either an oil or gas producing zone or a fluid injection zone), one or more additional casing strings will generally extend through the outer string of casing to increasing depths in the well until the well is cased to the final depth. Each string of casing is supported at the tipper end by a casing hanger, which usually lands in and is supported by the wellhead housing.

A casing hanger packoff or annular seal assembly is set in a seal pocket between the casing hanger and the wellhead housing. The weight of the casing hanger and the casing hanging from the casing hanger can prevent upward movement of the casing hanger under some circumstances. A lockdown mechanism, however, may be required to lock the casing hanger in place and can be used to lock the annular seal assembly to the wellhead housing when the casing hanger is subjected to high pressure. Those high pressures can cause the casing hanger to move axially upward. Expansion and contraction of the casing can also cause the annular seal to be compromised and cause leaking.

The lockdown mechanism can be a separate assembly lowered onto the upper casing hanger and locked to the wellhead housing. The lockdown mechanism can alternately comprise a lookdown ring earned by the casing hanger and moved radially to engage a profile in the wellhead housing. The radial movement may be in response to setting of the casing hanger seal. Engaging surfaces mate to resist the upward forces.

Even with a lockdown mechanism, a portion of the upward forces imposed on the casing hanger may be directed upward through the seal portion of the casing hanger seal and from the seal portion, into the body of the wellhead housing. The upward forces can damage the ability of the casing hanger to seal against the side wall of the bore in the wellhead housing.

A wellhead assembly comprises a wellhead housing having a bore with an axis. The bore has a downward and inward facing lock-down profile shoulder. A casing hanger lands in the bore and supports a string of casing. The casing hanger has an external upward-facing casing hanger shoulder. A radially expandable annular lockdown member carried on the casing hanger shoulder moves between a retracted position and an expanded position. The lockdown member has an upward and outward facing lockdown member shoulder that engages the lockdown profile shoulder while in the expanded position. The lockdown member has an upward and inward lacing cam surface.

A casing hanger seal carried by the casing hanger moves downward into a seal pocket between the casing hanger and the wellhead housing while being run. A running tool radially deforms the seal into a set position while in the seal pocket. An extension on a lower end of the casing hanger seal has a downward and outward facing cam surface that engages the cam surface on the lockdown ring. The cam surface on the seal extension moves the lockdown member to the expanded position while the casing hanger seal is moved into the seal pocket. A plurality of slots are formed in the extension. The slots have upper and lower sides that are in planes perpendicular to the axis.

At least some of the slots may be located above the cam surface on the extension. The slots are axially spaced apart from each other a distance at least equal to a dimension between the upper and lower sides of each of the slots.

The extension has an inward lacing surface and an outward facing surface. At least some of the slots are formed in the outward facing surface. In one embodiment, at least some of the slots are formed in the inward facing surface. In another embodiment, at least some of the slots are formed in the inward facing surface, and at least some of the slots are formed in the outward facing surface. In that embodiment, the slots in the inward facing surface alternate with the slots formed in the outward facing surface.

Each of the slots may have a radial dimension that is greater than one-half a thickness of the extension between the inward facing surface and the outward facing surface measured at the location of each of the inner and outer slots.

In the embodiment having both inner and outer slots, closed ends of at least some of the inner slots are located between two of the outer slots. Closed ends of at least some of the outer slots are located between two of the inner slots.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only one embodiment of the invention and is therefore not to be considered limiting of its scope as the invention may admit to other equally effective embodiments.

DETAILED DESCRIPTION OF THE DISCLOSURE

Figure 1:
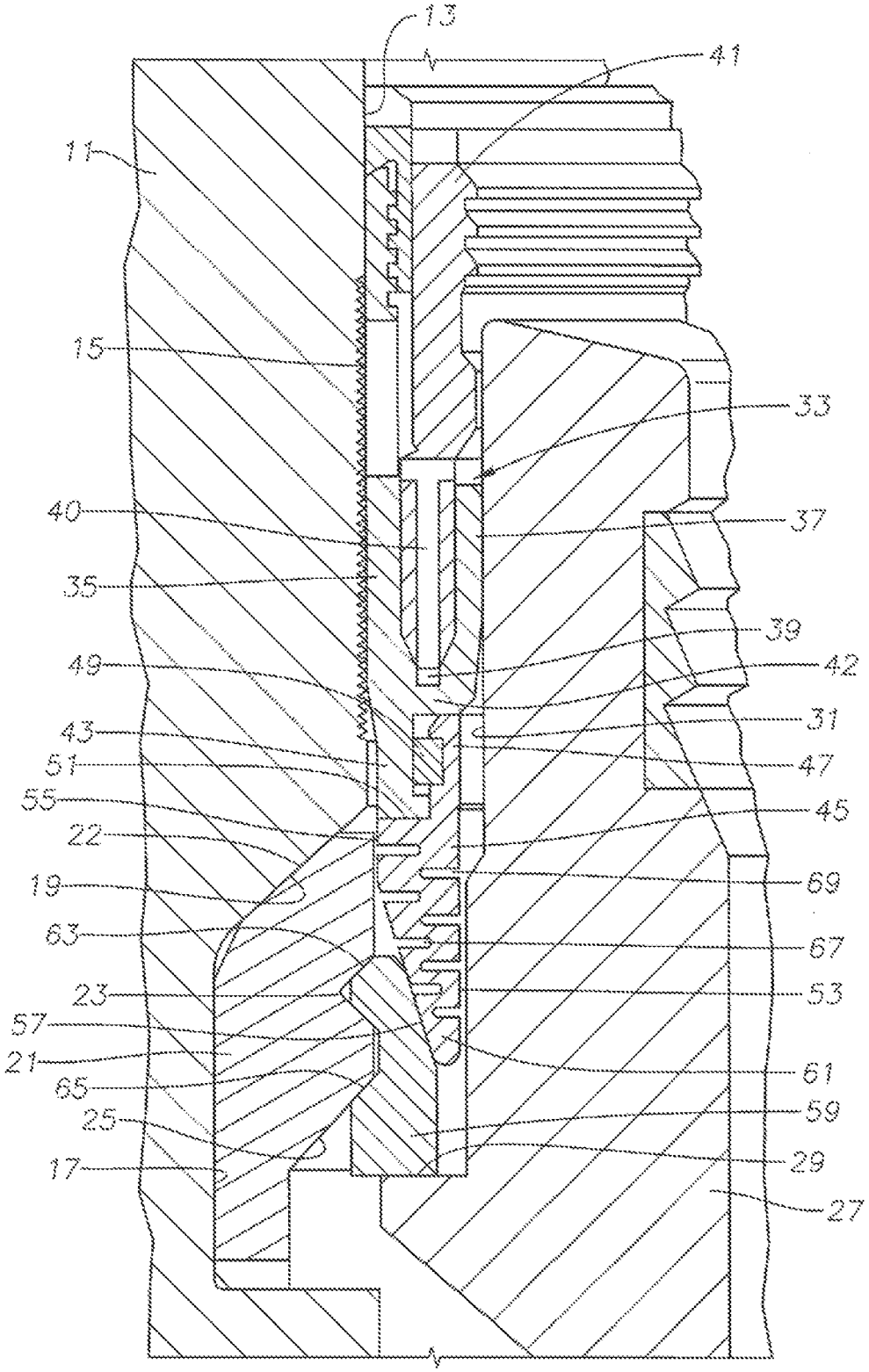
FIG. 1 is a sectional view of a portion of a wellhead assembly with a casing hanger seal assembly in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein;

rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. The terms "vertical", "horizontal", "upward", "downward", "above", and "below" and similar spatial relation terminology are used herein only for convenience because elements of the current disclosure may be installed in various relative positions.

Referring to FIG. 1, a wellhead assembly includes a tubular wellhead member, such as wellhead housing 11, with a central bore 13 having a longitudinal axis. Wellhead housing 11 is a high pressure tubular member typically located subsea over a well (not shown). Wellhead housing 11 is normally located in the bore of an outer or low pressure wellhead housing (not shown). Wellhead housing 11 secures to a first string of casing (not shown), which extends through a conductor pipe to a depth into the well. The side wall of bore 13 optionally has wickers 15 located above lockdown profile ring 19, the wickers comprising parallel annular saw tooth grooves.

The side wall of bore 13 has an annular lockdown recess 17, which has a conical shoulder 19 that faces downward and inward relative to an axis of bore 13. In this embodiment a lockdown supporting member 21 fits within lockdown recess 17. Lockdown supporting member 21 comprises a plurality of arcuate segments that insert into lockdown recess 17 to define an annular configuration for lockdown supporting member 21. Lockdown supporting member 21 may be formed of a harder metal having a greater yield strength than the metal of wellhead housing 11. Lockdown supporting member 21 has on its outer side a conical upward and outward facing shoulder 22 that mates with lockdown recess shoulder 19. Lockdown supporting member 21 has on its inner side at least one and preferably two conical lockdown profile shoulders 23, 25 that face downward and inward. Shoulder 23 is located in a triangular recess and is above shoulder 25. Circumferentially spaced apart channels (not shown) are formed on the inner side of lockdown supporting member 21 to facilitate the return of drilling fluid during cementing of the well casing.

A casing hanger 27 lands on a load shoulder (not shown) below lockdown recess 17 in bore 13. Casing hanger 27 secures to a string of casing (not shown) extending into the well. Casing hanger 27 has an upward facing external shoulder 29 that may be in a plane perpendicular to the axis of bore 13. Casing hanger shoulder 29 is located at the lower end of a cylindrical upper exterior portion or neck of casing hanger 22, the neck being spaced inward a selected distance from the side wall of bore 13 to define a seal pocket 31.

A casing hanger seal at packoff assembly 33 is lowered into seal pocket 32 after the casing has been cemented. When set, seal assembly 33 forms a sealing engagement with wickers 15 and the upper exterior portion of casing hanger 27. Seal assembly 31 may have various configurations. In this example, seal assembly 33 has an annular outer wall or leg 35 and an annular inner wall or leg 37, both of which are formed of metal. An annular energizing ring slot 39 separates outer leg 35 from inner leg 37.

An energizing ring 41, which, has a lower portion of greater width than energizing ring slot 39, will deform legs 35, 37 radially apart from each other when its lower portion is forced down into energizing ring slot 39. When forced radially outward and inward, legs 35, 37 form seals with wickers 15 and an exterior portion of casing hanger 27. A running tool (not shown) lowers seal assembly 33 into seal pocket 31, then forces energizing ring 41 downward. Vent passages 40 in energizing ring 41 vent liquid trapped in energizing ring slot 39.

Outer and inner legs 35, 37 are integrally joined at their lower ends by a base 42. A connection leg 43 integrally joins base 42 and extends downward. Connection leg 43 is a cylindrical member that in this example, has an outer diameter approximately the same as the outer diameter of outer leg 35 prior to setting. Connection leg 43 has an inner diameter approximately the same as the inner diameter of outer leg 35 prior to setting. The length of connection leg 43 is much less than the length of inner leg 37.

A metal nose ring 45 secures to connection leg 43 and extends downward. Nose ring 45 and connection leg 43 may be considered to be a lower extension of seal assembly 33. Nose ring 45 has a cylindrical neck 47 extending upward on the inner side of connection leg 43. A retaining ring 49, which may be a split ring, fits between grooves formed in the inner side of connection leg 43 and the outer side of nose ring neck 47. Retaining ring 49 secures nose ring 45 to connection leg 43. Nose ring 45 has an upward facing flat shoulder 51 that abuts a flat lower end on connection leg 43. The upper end of nose ring neck 47 may abut a lower side of seal assembly base 42.

Nose ring 45 has an inner or inward facing side 53 that may be cylindrical and extends from the upper end of neck 47 to the lower end of nose ring 45. In this example, inner side 53 has an inner diameter slightly greater than the inner diameter of inner leg 37 prior to setting, but that could differ. Nose ring 45 has an outer or outward facing side that in this example includes a cylindrical upper portion 55 extending downward from nose ring shoulder 51. The enter side of nose ring 45 has an outward and downward facing conical portion or cam surface 57. Nose ring cam surface 57 joins upper cylindrical portion 55 and extends down to the lower end of nose ring 45. Nose ring 45 is not radially expansible.

A radially expansible metal lockdown ring 59 is located on casing hanger external shoulder 29. Lockdown ring 59 may be a split ring, a collet member with serpentine slots, or some other type of expansible ring. Lockdown ring 59 has on its inner side a conical cam surface 61 that faces upward and inward. Lockdown ring 59 has on its outer side two conical shoulders 63, 65 that mate with lockdown supporting member shoulders 23, 25. Lockdown ring shoulder 65 is spaced below lockdown ring shoulder 63 and is located in an annular recess. Nose ring cam surface 57 mates with lockdown ring cam surface 61, and when nose ring 45 is moved downward, slides along cam surface 61 and pushes lockdown ring 59 radially outward into engagement with lockdown supporting member shoulders 23, 25.

Figure 2:
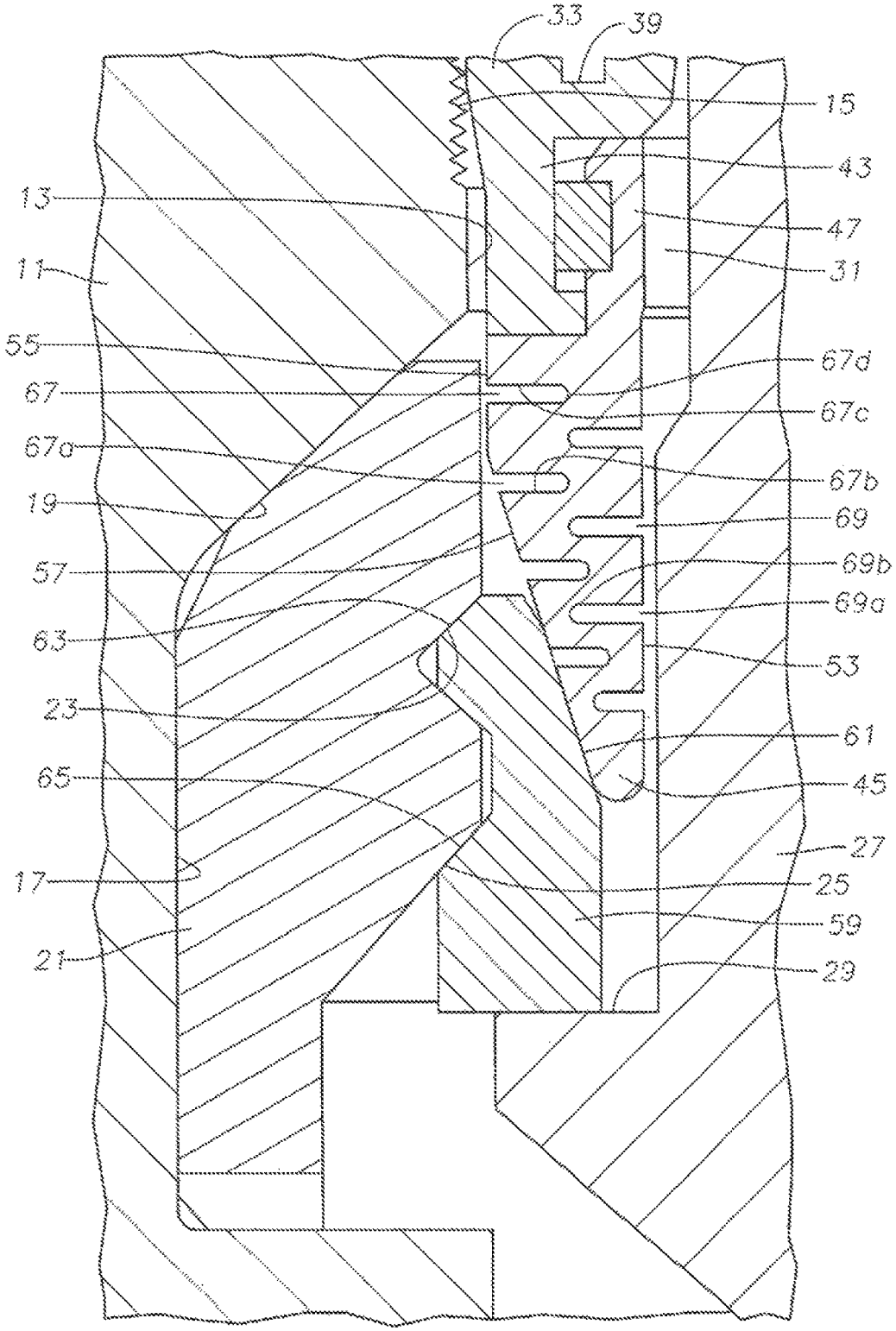
FIG. 2 is an enlarged sectional view of a portion of the casing hanger seal assembly of FIG. 1.

Referring to FIG. 2, a plurality of slots are formed in the lower extension of seal assembly 33, the extension comprising connection leg 43 and nose ring 45. In FIG. 2, the slots include outer slots 67 and inner slots 69 formed in nose ring 45. Outer slots 67 alternate with inner slots 69 along the length of nose ring 45. In this example, two of the outer slots 67 extend radially inward from nose ring upper cylindrical surface 55; the remaining outer slots 67 extend radially inward from nose ring cam surface 57. Inner slots 69 are located on the inner side 53 of nose ring 45 below neck 47. Each outer slot 67 and inner slot 69 is annular, preferably extending a full 360 degrees.

Each outer slot 67 has an open end 67*a* on the outer side of nose ring 45 and a closed end 67*b*. Each outer slot 67 has an upper side 67*c* and a lower side 67*d* that are parallel with each other and located in radial planes perpendicular to the axis of bore 13. The radial dimension or length of each outer slot 67 can vary; in the embodiment shown, the radial length of each outer slot 67 is one-half or more the radial thickness of nose ring 45 measured at that point. The radial lengths of some of the outer slots 67 can differ from the radial lengths of others. For example, the radial lengths of outer slots 67 in the upper thicker portions of nose ring 45 may be longer than in the lower thinner portions of nose ring 45. The width of each outer slot 67 from upper side 67*c* to lower side 67*d* can also vary. In the embodiment shown, the axial width of each outer slot 67 is less than the distance between outer slots 67. The distance between each outer slot 67 and the outer slots 67 directly above and below, can also vary.

Inner slots 69 may be identical in dimensions to outer slots 67. Each inner slot 69 has an open end 69*a* on nose ring inner side 53 and a closed end 69*b*. Except for the lowest inner slot 69, each inner slot 69 is located an axial distance half-way between two of the outer slots 67. Also, the closed ends 67*b*, 69*b* overlap with one another. For example, the uppermost inner slot 69 illustrated has a closed end 69*b* closer to nose ring outer cylindrical surface 55 than the closed ends 67*b* directly above and below the uppermost inner slot 69. The inner slots 69 adjacent nose ring cam surface 57 have closed ends 69*b* closer to cam surface 57 than the outer slot closed ends 67*b* directly above and below. Closed ends 69*b* are thus located between two of the outer slots 67. This arrangement of outer and inner slots 67, 69 creates a serpentine section of metal in the body of nose ring 45 from the lower end to nose ring shoulder 51.

During the installation process, lockdown support member 21 will be installed in wellhead housing lockdown recess 17 before wellhead housing 11 is run. After wellhead housing 11 is installed, along with its outer casing string (not shown), the well is drilled deeper. At a desired depth, casing will be run through wellhead housing 11, attached to casing hanger 27, and cemented in the well. When casing hanger 27 is run, lockdown ring 59 will be retracted, with, its outer side approximately flush with the outer diameter of casing hanger external shoulder 29. The running tool (not shown) for seal assembly 33 may include seal assembly 33 while running casing hanger 27, but seal assembly 33 will be initially retained in an upper position above seal pocket 31. While pumping cement down the casing, displaced drilling fluid in the well flows upward through seal pocket 31.

After the cement has set, the naming tool moves seal assembly 33 down into seal pocket 31. Nose ring cam surface 57 engages lockdown ring cam surface 61 and pushes lockdown ring 59 radially outward into engagement with lockdown support member 21. Continued downward force on energizing ring 41 wedges inner and outer seal legs 37, 35 into sealing engagement with wellhead housing 11 and casing hanger 27. The outer surface of outer seal leg 35 embeds into wickers 15, forming a seal. Optionally, wickers could also be located on the portion of casing hanger 27 engaged by inner seal leg 37.

After installation, high pressures in the well and thermal growth of casing can exert an upward force on casing hanger 27. The upward force will pass from casing hanger external shoulder 29 through lockdown ring 59, into lockdown member support shoulders 23, 25, and into wellhead housing 11 through lockdown recess shoulder 19. Slots 67, 69 reduce the axial stiffness of the extension portion of seal assembly 33, which is made up of connection leg 43 and nose ring 45. The reduction in stiffness directs more of the upward forces along the load path mentioned rather than directly upward to outer and inner seal legs 35, 37. The redirection of upward forces reduces upward forces particularly that would otherwise be applied from outer seal leg 35 to wickers 15.

Figure 3:
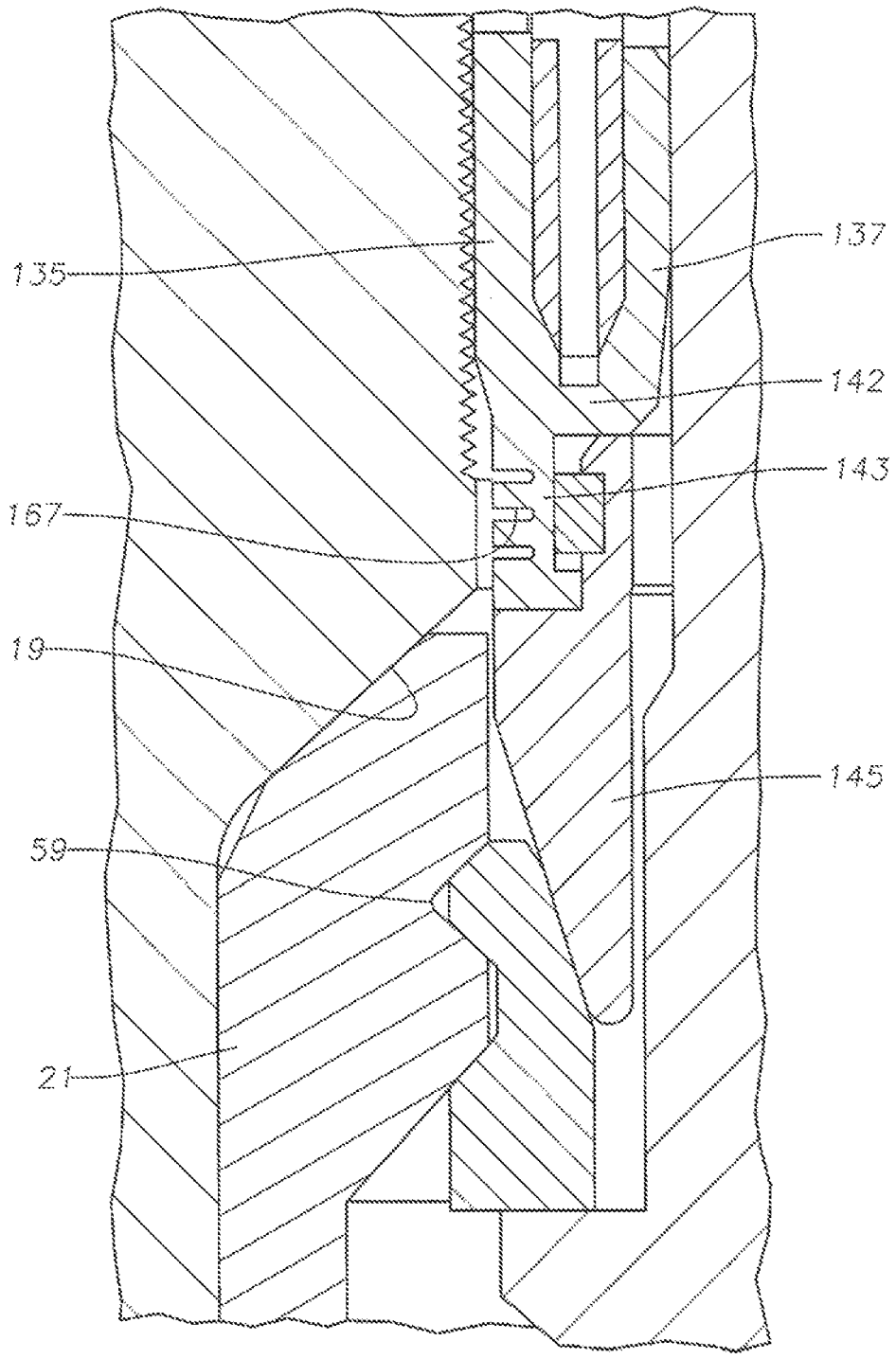
FIG. 3 is a sectional view of an alternate embodiment of the casing hanger seal assembly of FIG. 1.

In the second embodiment of FIG. 3, components that are the same as in the first embodiment employ the same reference numerals. In this embodiment, only outer slots 167 are used, not inner slots, such as inner slots 69 (FIG. 2). Also, outer slots 167 may be formed in connection leg 143 below outer and inner seal legs 135, 137, rather than in nose ring 145. Outer slots 167 are located on the outer diameter side of connection leg 143. As in the first embodiment, outer slots 167 have upper and lower sides parallel to each other and to the axis. The radial lengths of outer slots 167 may be equal or greater than one-half the radial thickness of connection leg 143. All of the outer slots 167 are located in connection leg 143 below base 142, which joins outer seal leg 135 with inner seal leg 137.

Slots 167 reduce the axial stiffness of connection leg 143 in somewhat a different manner that slots 67, 69 of FIG. 2 reduce the stiffness of nose ring 45, which define a serpentine pattern for the body nose ring 45. Slots 167 are located on only one side of connection leg 143 and reduce axial stiffness by lowering the average thickness of connection leg 143. The reduction in axial stiffness of connection leg 143 directs more of the upward forces on casing hanger 27 through lockdown ring 59, lockdown support member 21 into wellhead housing lockdown shoulder 19.

The system and method described herein, therefore, are well adapted to carry out the objects and attain the ends and advantages mentioned, as well as others inherent therein. While two embodiments of the system and method have been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

The invention claimed is:

1. A wellhead assembly, comprising:

a wellhead housing having a bore with an axis;

a downward and inward facing lockdown profile shoulder in the bore;

a casing hanger landed in the bore for supporting a string of casing, the casing hanger having an external upward-facing casing hanger shoulder;

a radially expandable annular lockdown member carried on the casing hanger shoulder for movement between a retracted position and an expanded position, the lockdown member having an upward and outward facing lockdown member shoulder that engages the lockdown profile shoulder while in the expanded position, the lockdown member having an upward and inward facing cam surface;

a casing hanger seal carried by the casing hanger, the casing hanger seal being downwardly movable into a seal pocket between the casing hanger and the wellhead housing while being run and radially deformable into a set position while in the seal pocket;

an extension on a lower end of the casing hanger seal, the extension having a downward and outward facing cam surface that engages the cam surface on the lockdown member and moves the lockdown member to the expanded position while the casing hanger seal is moved into the seal pocket; and a plurality of slots in the extension, the slots having upper and lower sides that are in planes perpendicular to the axis, wherein the slots are axially spaced apart from each other a distance at least equal to a dimension between the upper and lower sides of each of the slots.

2. The wellhead assembly according to claim 1, wherein at least some of the slots are located above the cam surface on the extension.

3. The wellhead assembly according to claim 1, wherein:

the extension has an inward facing surface and an outward facing surface; and at least some of the slots are formed in the outward facing surface.

4. The wellhead assembly according to claim 1, wherein:

the extension has an inward facing surface and an outward facing surface; and at least some of the slots are formed in the inward facing surface.

5. The wellhead assembly according to claim 1, wherein:

the extension has an inward facing surface and an outward facing surface;

at least some of the slots are formed in the inward facing surface; and at least some of the slots are formed in the outward facing surface.

6. The wellhead assembly according to claim 1, wherein:

the extension has an inward facing surface and an outward facing surface;

at least some of the slots are formed in the inward facing surface;

at least some of the slots are formed in the outward facing surface; and the slots in the inward facing surface alternate with the slots formed in the outward facing surface.

7. The wellhead assembly according to claim 1, wherein:

the extension has an inward facing surface and an outward facing surface;

at least some of the slots comprise inner slots formed in the inward facing surface;

at least some of the slots comprise outer slots formed in the outward facing surface;

the inner slots alternate with the outer slots along a length of the extension;

each of the inner slots and the outer slots has a radial dimension that is greater than one-half a thickness of the extension between the inward facing surface and the outward facing surface measured at the location of each of the inner and outer slots.

8. The wellhead assembly according to claim 1, wherein:

the extension has an inward facing surface and an outward facing surface;

at least some of the slots comprise inner slots formed in the inward facing surface;

at least some of the slots comprise outer slots formed in the outward facing surface;

the inner slots alternate with the outer slots along a length of the extension;

each of the inner slots and the outer slots has a closed end;

the closed ends of at least some of the inner slots are located between two of the outer slots; and the closed ends of at least some of the outer slots are located between two of the inner slots.

9. A wellhead assembly, comprising:

a wellhead housing having a bore with an axis;

a downward and inward facing lockdown profile shoulder in the bore;

a casing hanger landed in the bore for supporting a string of casing, the casing hanger having an external upward-facing casing hanger shoulder;

a radially expandable annular lockdown member carried on the casing hanger shoulder for movement between a retracted position and an expanded position, the lockdown member having an upward and outward facing lockdown member shoulder that engages the lockdown profile shoulder while in the expanded position, the lockdown member having an upward and inward facing cam surface;

a casing hanger seal carried by the casing hanger, the casing hanger seal being downwardly movable into a seal pocket between the casing hanger and the wellhead housing while being run and radially deformable into a set position while in the seal pocket;

a connection leg joining and extending downward from the casing hanger seal;

a nose ring connected to and extending downward from the connection leg, the nose ring having an inward facing surface and an outward facing surface, the outward facing surface including a downward and outward facing cam surface that engages the cam surface on the lockdown member and moves the lockdown member to the expanded position while the casing hanger seal is moved into the seal pocket; and a plurality of slots in the nose ring, the slots having upper and lower sides that are in planes perpendicular to the axis, wherein at least some of the slots are formed in the inward facing surface of the nose ring.

10. The wellhead assembly according to claim 9, wherein at least some of the slots are located above the cam surface on the nose ring.

11. The wellhead assembly according to claim 9, wherein the slots are axially spaced apart from each other a distance at least equal to a dimension between the upper and lower sides of each of the slots.

12. The wellhead assembly according to claim 9, wherein:

the nose ring has an inward facing surface and an outward facing surface that includes the cam surface on the nose ring; and at least some of the slots are formed in the outward facing surface.

13. The wellhead assembly according to claim 9, wherein:

the nose ring has an inward facing surface and an outward facing surface that includes the cam surface on the nose ring;

at least some of the slots are formed in the inward facing surface;

at least some of the slots are formed in the outward facing surface; and the slots in the inward facing surface alternate with the slots formed in the outward facing surface.

14. The wellhead assembly according to claim 9, wherein:

the nose ring has a cylindrical outer diameter surface extending upward from the cam surface on the nose ring; and some of the slots are formed in the cylindrical outer diameter surface and some in the cam surface on the nose ring.

15. A wellhead assembly, comprising:

a wellhead housing having a bore with an axis;

a downward and inward facing lockdown profile shoulder in the bore;

a casing hanger landed in the bore for supporting a string of casing, the casing hanger having an external upward-facing casing hanger shoulder;

a radially expandable annular lockdown member carried on the casing hanger shoulder for movement between a retracted position and an expanded position, the lockdown member having an upward and outward facing lockdown member shoulder that engages the lockdown profile shoulder while in the expanded position, the lockdown member having an upward and inward facing cam surface;

a casing hanger seal carried by the casing hanger, the casing hanger seal being downwardly movable into a seal pocket between the casing hanger and the wellhead housing while being run and radially deformable into a set position while in the seal pocket;

a connection leg joining and extending downward from the casing hanger seal;

a nose ring connected to and extending downward from the connection leg, the nose ring having a downward and outward facing cam surface that engages the cam surface on the lockdown member and moves the lockdown member to the expanded position while the casing hanger seal is moved into the seal pocket; and a plurality of slots in the connection leg, the slots having upper and lower sides that are in planes perpendicular to the axis.

16. The wellhead assembly according to claim 15, wherein the slots are axially spaced apart from each other a distance at least equal to a dimension between the upper and lower sides of each of the slots.

17. The wellhead assembly according to claim 15, wherein:

the connection leg has an inward facing surface and an outward facing surface; and the slots are formed in the outward facing surface.

18. The wellhead assembly according to claim 15, wherein:

the connection leg has an inward facing surface and an outward facing surface;

the slots have open ends in the outward facing surface;

the slots have closed ends closer to the inward facing surface than the outward facing surface.

* * * * *